US009625240B2

(12) United States Patent
McDonald et al.

(10) Patent No.: US 9,625,240 B2
(45) Date of Patent: Apr. 18, 2017

(54) ENHANCED LINEAR SHAPED CHARGE INCLUDING SPINAL CHARGE ELEMENT

(71) Applicant: Goodrich Corporation, Charlotte, NC (US)

(72) Inventors: Steven McDonald, Fairfield, CA (US); Dennis Way, Vacaville, CA (US)

(73) Assignee: GOODRICH CORPORATION, Charlotte, NC (US)

( * ) Notice: Subject to any disclaimer, the term of this patent is extended or adjusted under 35 U.S.C. 154(b) by 0 days.

(21) Appl. No.: 14/951,680

(22) Filed: Nov. 25, 2015

(65) Prior Publication Data

US 2016/0076861 A1 Mar. 17, 2016

Related U.S. Application Data

(62) Division of application No. 13/964,300, filed on Aug. 12, 2013, now abandoned.

(51) Int. Cl.

| | |
|---|---|
| ***F42B 1/02*** | (2006.01) |
| ***F42B 1/028*** | (2006.01) |
| ***F42B 3/08*** | (2006.01) |

(52) U.S. Cl.

CPC ..... *F42B 1/02* (2013.01); *F42B 1/028* (2013.01); *F42B 3/08* (2013.01)

(58) Field of Classification Search

CPC .. F42B 1/02; F42B 1/028; F42B 1/032; F42B 3/08

USPC ..... 102/305, 306, 307, 308, 309, 310, 476

See application file for complete search history.

(56) References Cited

U.S. PATENT DOCUMENTS

| | | | | |
|---|---|---|---|---|
| 3,491,688 | A | 1/1970 | Clay et al. | |
| 3,561,361 | A | 2/1971 | Kessenich et al. | |
| 4,126,092 | A * | 11/1978 | Cross | F42B 1/02 102/307 |
| 4,430,939 | A | 2/1984 | Harrold | |
| 4,498,367 | A | 2/1985 | Skolnick et al. | |
| 4,594,946 | A | 6/1986 | Ringel et al. | |
| 4,627,353 | A * | 12/1986 | Chawla | F42B 1/02 102/307 |
| 4,632,036 | A | 12/1986 | Ringel | |
| 4,896,609 | A * | 1/1990 | Betts | F42B 1/02 102/307 |
| 5,223,666 | A | 6/1993 | Delaney, Jr. | |
| 5,333,550 | A | 8/1994 | Rodney et al. | |

(Continued)

FOREIGN PATENT DOCUMENTS

| | | | |
|---|---|---|---|
| FR | 2067874 | A5 | 8/1971 |
| FR | 2268243 | A1 | 11/1975 |

(Continued)

*Primary Examiner* — James S Bergin
(74) *Attorney, Agent, or Firm* — Cantor Colburn LLP

(57) ABSTRACT

An enhanced linear shaped charge (X-Jet) includes a sheath and a spinal charge element. The sheath extends along an axis between a first end and a second end to define a sheath length. The sheath has a first hollowed chevron-shaped cross-section that defines a main charge cavity, an upper apex, and a lower apex. The spinal charge element is disposed within the main charge cavity and abuts the upper apex. The spinal charge element further includes a spinal casing that extends along the sheath length to define a spinal length. The spinal casing has a hollowed cross-section defining a spinal charge cavity.

12 Claims, 5 Drawing Sheets

(56) References Cited

U.S. PATENT DOCUMENTS

| | | | | |
|---|---|---|---|---|
| 5,415,101 | A * | 5/1995 | Brinkmann | F42B 1/02 102/307 |
| 5,501,154 | A | 3/1996 | Rodney et al. | |
| 5,814,758 | A | 9/1998 | Leidel et al. | |
| 5,827,995 | A | 10/1998 | Graham et al. | |
| 7,086,629 | B2 * | 8/2006 | Hilden | B26F 3/04 102/306 |
| 7,536,956 | B2 | 5/2009 | Sammons et al. | |
| 8,904,934 | B1 | 12/2014 | Scheid | |
| 8,978,558 | B2 | 3/2015 | Lumley | |
| 9,045,692 | B2 | 6/2015 | Lumley | |
| 2015/0013561 | A1 | 1/2015 | Chartier et al. | |

FOREIGN PATENT DOCUMENTS

| | | | |
|---|---|---|---|
| GB | 2213241 | A | 8/1989 |
| GB | 2254402 | A | 7/1992 |

* cited by examiner

ENHANCED LINEAR SHAPED CHARGE INCLUDING SPINAL CHARGE ELEMENT

DOMESTIC PRIORITY

This application is a division of U.S. patent application Ser. No. 13/964,300, filed Aug. 12, 2013, the disclosure of which is incorporated by reference herein in its entirety.

BACKGROUND

Various embodiments of the disclosure pertain to linear shaped charges, and more particularly, to a linear shaped charge including a spinal charge element.

A linear shaped charge (LSC) is an explosive device consisting of an explosive material encased in a metal tube (or sheath). The sheath typically has a V-shaped cross-sectional profile that defines a lower apex. When the LSC is detonated at one end, a planar detonation wave propagates axially along the length of the LSC. As each cross-section is detonated, a high-velocity molten jet of sheath material is projected downward from the lower apex. The molten jet is capable of cutting through various metallic and non-metallic targets of various thicknesses depending on the explosive material load and the sheath material.

A conventional LSC generates a planar detonation wave that travels parallel to the length of the sheath and therefore perpendicular to the projected molten jet. Since the detonation wave is perpendicular to the molten jet, the molten jet does not realize the full force of the detonation wave and the detonation efficiency of the LSC is diminished.

BRIEF DESCRIPTION

According to an embodiment, an enhanced linear shaped charge (X-Jet) includes a sheath and a spinal charge element. The sheath extends along an axis between a first end and a second end to define a sheath length. The sheath has a first hollowed chevron-shaped cross-section that defines a main charge cavity, an upper apex, and a lower apex. The spinal charge element is disposed within the main charge cavity and abuts the upper apex. The spinal charge element further includes a spinal casing that extends along the sheath length to define a spinal length. The spinal casing has a hollowed cross-section defining a spinal charge cavity.

According to another embodiment, a method of detonating a linear shaped charge (LSC) having a sheath configured to contain explosive charge material comprises loading a spinal charge material in an upper apex of the sheath to generate a spinal detonation wave having a spinal detonation velocity. The method further comprises loading a main charge material in the sheath to completely surround the spinal charge material. The main charge material is configured to produce a main detonation wave having a main detonation velocity that is less than the spinal detonation velocity. The method further comprises detonating the spinal charge material to generate the spinal detonation wave that travels in a spinal direction. The method further comprises detonating the main charge material via the spinal detonation wave to generate the main detonation wave. The main detonation wave generates a molten jet that projects from the X-jet and travels in a direction that is parallel to the direction of the main detonation wave.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
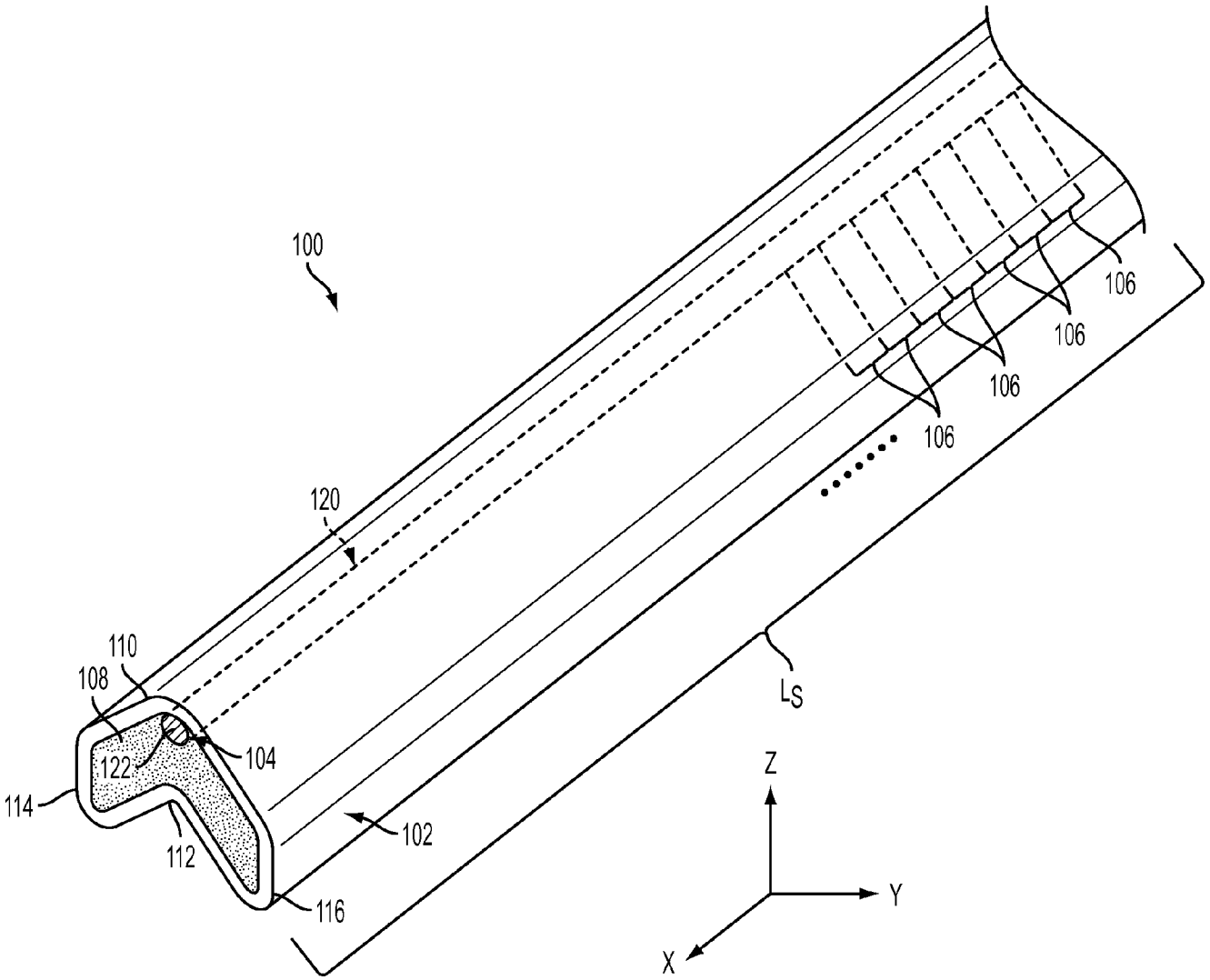
FIG. 1 is an isometric view of an X-Jet device according to an embodiment of the disclosure.
Figure 2:
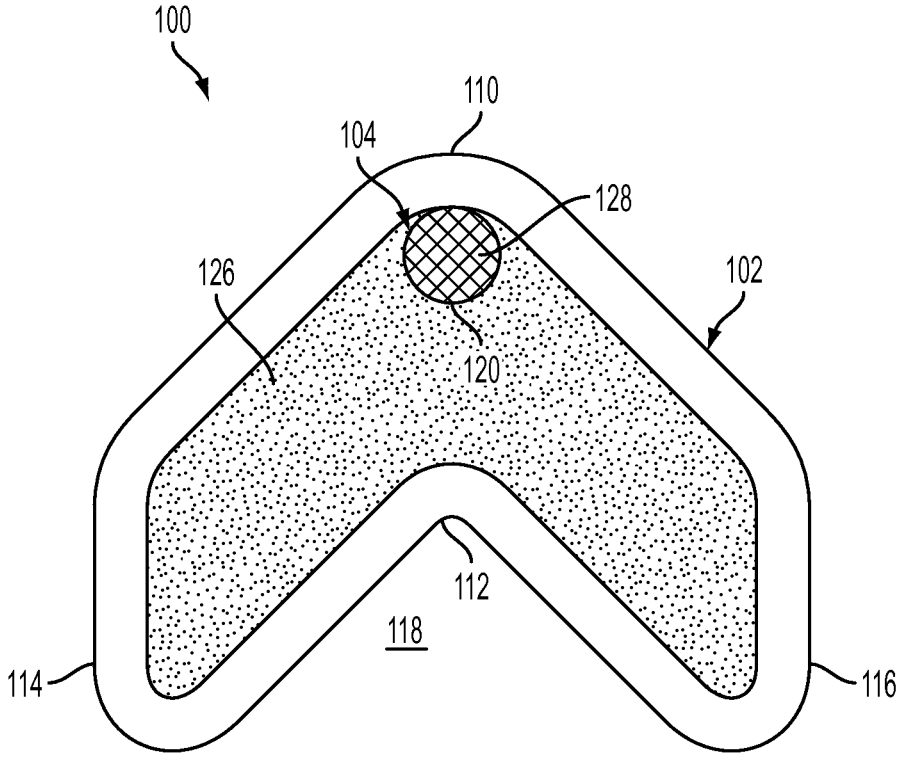
FIG. 2 is a cross-sectional view of an X-Jet device containing explosive charge material according to an embodiment.

Referring to FIGS. 1 and 2, a linear shaped charge (LSC) 100 is illustrated according to an embodiment. The LSC 100 is formed as an enhanced LSC, hereinafter referred to as an "X-Jet" 100, which improves efficiency and increases target penetration capability of a molten jet projected therefrom.

The X-Jet 100 includes a sheath 102 and a spinal charge element 104. The sheath 102 has a plurality of cross-sectional regions 106 extending along an axis (e.g., an X-axis) between a first end and a second end to define a sheath 102 length ($L_s$). The sheath 102 has a first hollowed chevron-shaped cross-section that defines the main charge cavity 108. The chevron-shaped cross-section defines an upper apex 110, a lower apex 112, a first leg 114, and a second leg 116. The first leg 114 and the second leg 116 are separated from one another by a void region 118. The sheath 102 may be formed from various materials including, but not limited to, aluminum, copper, tungsten, tantalum, depleted uranium, lead, tin, cadmium, cobalt, magnesium, titanium, zinc, zirconium, molybdenum, beryllium, nickel, silver, gold, and platinum. The spinal charge element 104 is located within the main charge cavity 108. The spinal charge element 104 may include a spinal casing 120 having a hollowed cross-section that defines a spinal charge cavity 122. The cross-section of the spinal charge element 104 may have various shapes including, but not limited to, a circular-shaped cross-section, a square-shaped cross-section, a diamond-shaped cross-section, and a polygonal-shape cross-section. In at least one embodiment, the spinal casing 120 extends along length (e.g., X-axis) of the sheath 102 to define a spinal length, and is aligned with the upper apex 110 and lower apex 112. The size of the spinal charge element 104 is less than the size of the upper apex 110 such that no air gap exists between the sheath 102 and the spinal casing 120.

In at least one embodiment, the spinal charge element 104 is formed as a separated spinal charge element 104 that is separate from the sheath 102 (see FIGS. 1-2). The spinal casing 120 may be formed from various materials including, but not limited to, metal and polymer. The spinal casing 120 and the sheath 102 may be formed of the same material, or of different materials.

Figure 3:
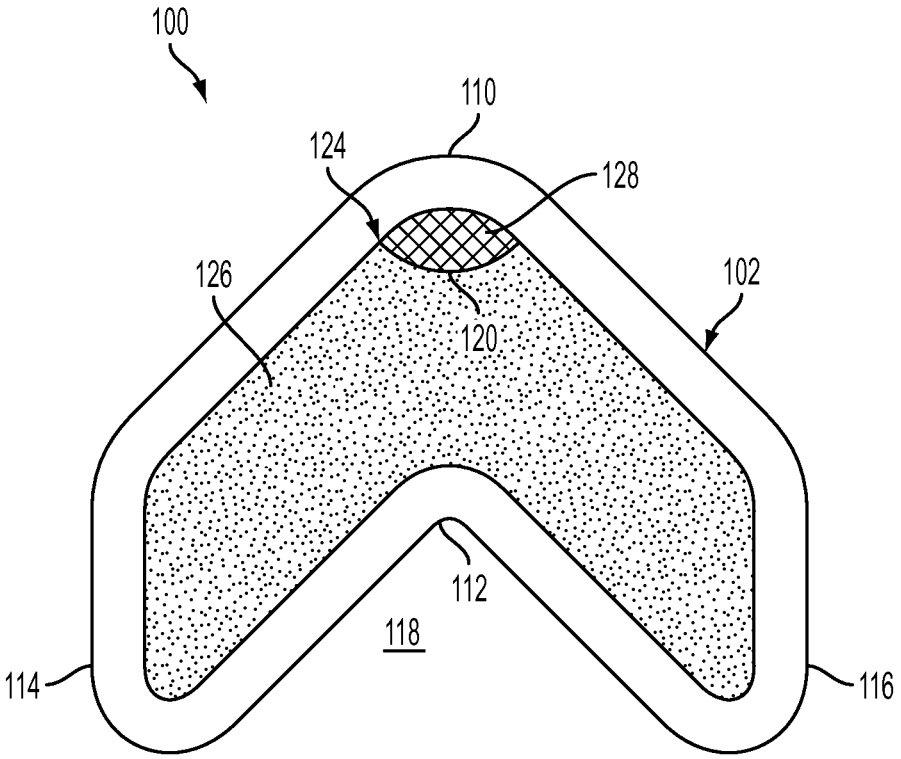
FIG. 3 is a cross-sectional view of an X-Jet device contain explosive charge material according to another embodiment.

In another embodiment illustrated in FIG. 3, the spinal charge element 104 is formed as an integrated spinal charge element 124 such that the spinal casing 120 is integrally formed with sheath 102. The integrated spinal charge element 124 may be formed, for example, by forming a spinal charge cavity through the outer and inner walls of the upper apex 110 (i.e., hollowing the upper apex 110) to define the spinal charge cavity 122. Accordingly, the integrated spinal charge element 124 is integrally formed from the upper apex 110 such that the sheath 102 and the integrated spinal charge element 124 are formed from the same material.

The X-Jet 100 may further include an explosive charge material contained in the main charge cavity 108 and/or the spinal charge cavity 122. When each of the main and spinal charge cavities 108, 122 is filled with a respective explosive charge material, the X-Jet is configured to generate a detonation wave 130 (see FIG. 4), which in turn projects a molten jet 132 that travels in a direction parallel to the detonation wave 130.

Referring still to FIGS. 1-4, for example, the main charge cavity 108 may be filled with a first type of explosive charge material 126 (i.e., a main charge material 126), and the spinal charge cavity 122 may be filled with a second type of explosive charge material 128 (i.e., the spinal charge material 128) that is different from the main charge material 126. Upon detonation, each of the spinal charge material and the main charge material produce a detonation wave having a detonation velocity. The detonation velocity of the explosive charge material dictates the rate at which the respective detonation wave propagates (i.e., the propagation rate).

In at least one embodiment, the main charge material 126 may have a detonation velocity (i.e., a main detonation velocity) that is less than the detonation velocity (i.e., spinal detonation velocity) of the spinal charge material 128. For example, the main charge cavity 108 may be filled with Hexanitrostilbene (HNS), which may have a detonation velocity ranging from 6000 meters/second to 7000 meters/second. The spinal charge cavity 122 may be filled with octogen (HMX), which may have a detonation velocity ranging from 8000 meters/second to 10,000 meters/second. Accordingly, when the main and spinal charge materials 126, 128 are detonated, the detonation of the spinal charge material 128 shall propagate along $L_s$ at a rate faster than the detonation of the main charge material 126.

The difference in detonation propagation rate may also be achieved by packing the main and spinal explosive charge materials 126, 128 at different densities with respect to one another. For example, the spinal charge material 128 may be packed in the spinal charge cavity 122 at a packing density greater than a packing density at which the main charge material 126 is packed in the main charge cavity 108. That is, the spinal charge material 128 is compressed within the spinal charge cavity 122 at a force greater than the main charge material 126 compressed within the main charge cavity 108. In at least one embodiment, the packing density of the spinal charge material 128 may be greater than the packing density of the main charge material 126 by a ratio ranging from approximately 1.2:1.0 to approximately 2.0:1.0. It is appreciated, however, that the packing density ratio is not limited thereto.

Figure 4:
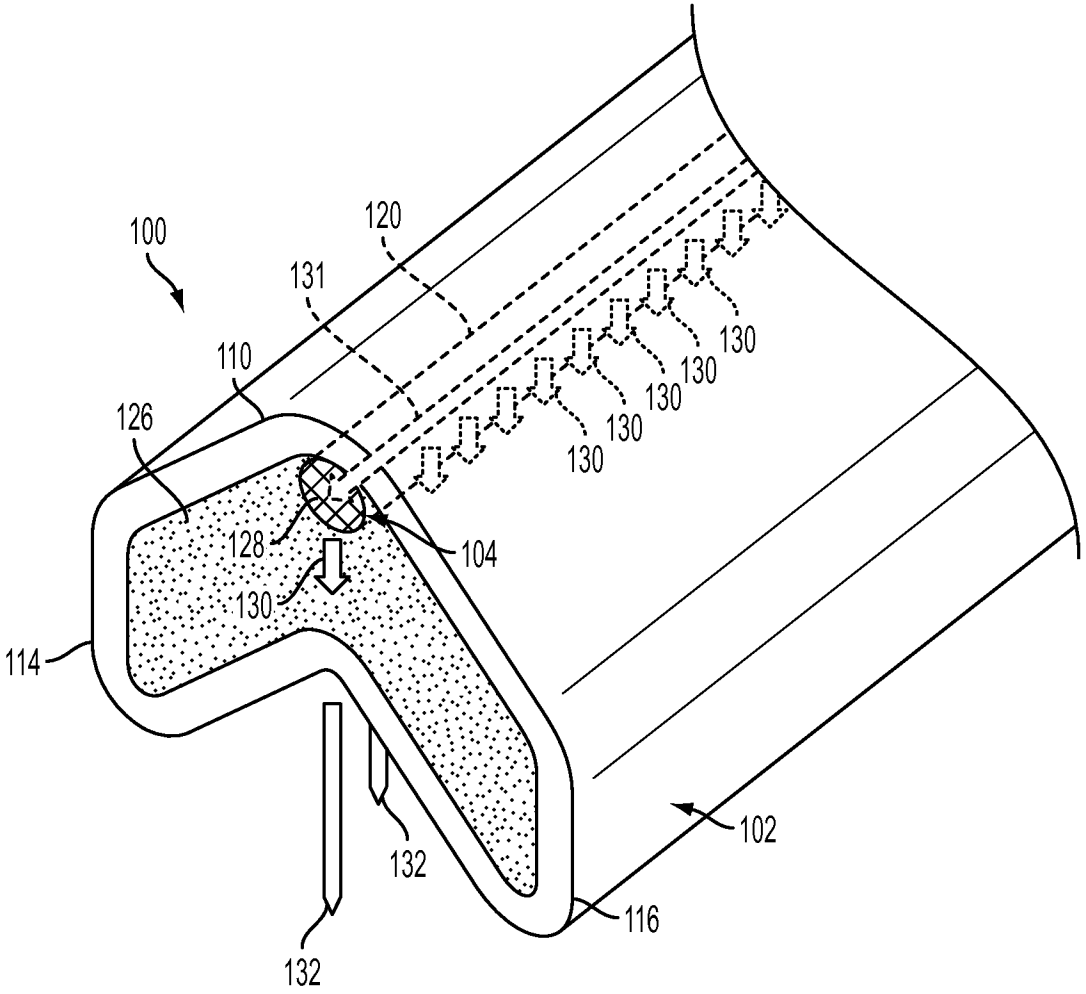
FIG. 4 illustrates the directions of the detonation waves and the projected jet following detonation of the explosive charge material of the X-Jet according to an embodiment.

Turning now to FIG. 4, the directions of the detonation waves in an X-Jet 100 are illustrated following detonation of the spinal charge material 128. The detonation may occur at various locations of the X-Jet 100. In at least one embodiment, a first detonation is initiated at one end of the sheath 102. It is appreciated, however, that the detonation may occur at the middle of the sheath, for example, at the middle of the spinal charge element 104. The detonation of the spinal charge material 128 generates a spinal detonation wave 131 that travels parallel to $L_s$. The spinal detonation wave 131 then continues to propagate along the length of the X-Jet toward the opposing end(s) of the sheath 102.

In response to the spinal detonation wave 131, a subsequent detonation of the main charge material 126 is induced, generating a main detonation wave 130 in the main charge material 126. The main detonation wave 130 travels perpendicular to the length of the X-Jet and toward the lower apex 112. As the spinal detonation wave 131 propagates along $L_s$ at spinal a propagation rate (i.e., a spinal propagation rate) that is faster than the propagation rate (i.e., main propagation rate) of the main detonation wave 130, the main charge material 126 is detonated at each respective cross-sectional region 106. The detonation of the main charge material 126 at each respective cross-section 106 creates a main detonation wave 130 that propagates toward the lower apex 112 at each respective cross section. Accordingly, the main charge material 126 is sequentially detonated in an asynchronous manner (See FIG. 4), as opposed to detonating the entire cross-section of the sheath 102 simultaneously.

The main detonation wave 130 in the main charge material 126 causes the legs 114 and 116 to collapse and generates a molten jet 132. The molten jet 132 travels in a direction that is parallel to the direction of the main detonation wave 130 and is propelled from the sheath 102 in response to the detonation wave 130. In at least one embodiment, the molten jet 132 is propelled from the sheath 102 at the lower apex 112. Unlike a conventional LSC, which projects a molten jet in a direction perpendicular to a main detonation wave 130 propagating parallel to $L_s$, the X-Jet 100 directs the main detonation wave 130 in a direction parallel to the molten jet 132. The molten jet 132, therefore, realizes the maximum energy and potential of the detonation wave 130. Accordingly, the X-Jet 100 achieves improved detonation efficiency and increases the penetration capability of a molten jet 132.

Figure 5:
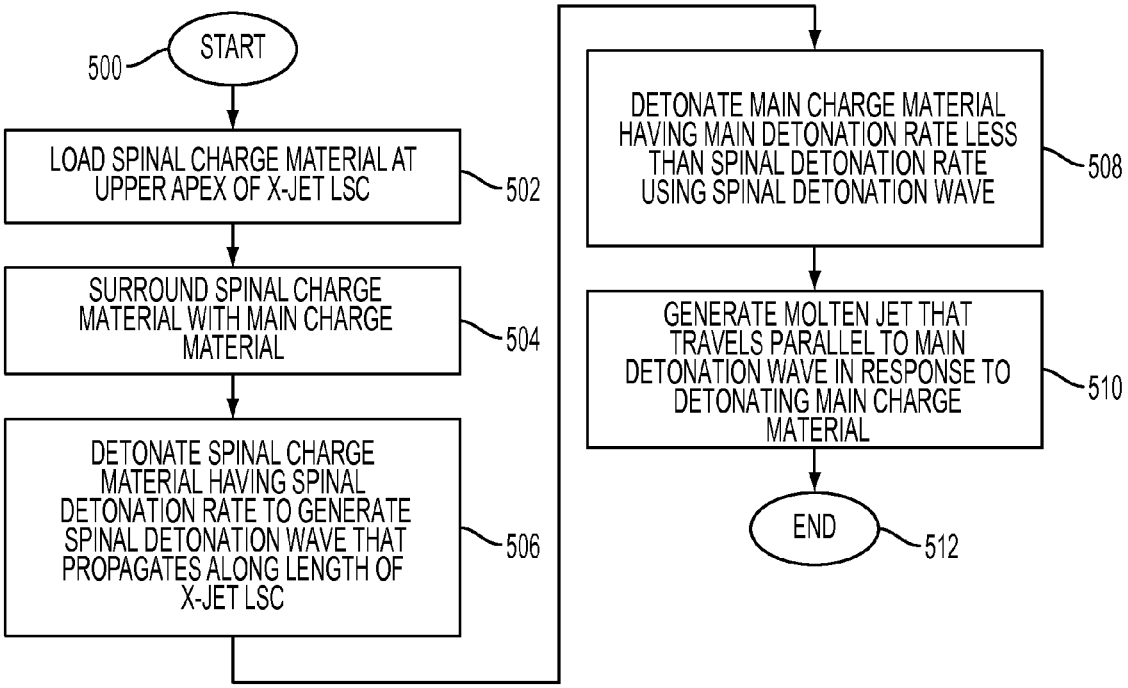
FIG. 5 is a flow diagram illustrating a method of assembling and detonating an X-Jet according to an embodiment.

Turning now to FIG. 5, a flow diagram illustrates a method of assembling and detonating an X-Jet according to at least one embodiment. The method begins at operation 500, and proceeds to operation 502 where a spinal charge material is loaded at an upper apex of the X-Jet sheath. In at least one example, a spinal charge containing the spinal charge material extends along the upper apex. At operation 504, a main charge material is loaded in the sheath. The main charge material may completely surround the spinal charge material. According to one example, the main charge material may be different from the spinal charge material and have a different detonation velocity than the detonation velocity of the spinal charge material. In another example, the main charge material may be the same as the spinal charge material but loaded according to a packing density that is different from the packing density of the spinal charge material.

At operation 506, the spinal charge material is detonated to generate a first propagation rate (i.e., a spinal propagation rate). The detonation of the spinal charge material induces a spinal detonation wave that propagates along the length of the X-Jet. At operation 508, the spinal detonation wave induces a detonation of the main charge material. The main charge detonation has a main charge propagation rate (i.e., a main charge detonation rate) that is less than the propagation rate of the spinal detonation wave and propagates in a direction perpendicular to the propagation direction of the spinal detonation wave. At operation 510, a molten jet traveling in a direction parallel to the main detonation wave is generated in response to the detonation of the main charge material, and the method ends at operation 512. Accordingly, detonation efficiency is improved and overall penetration capability of the molten jet is increased.

While various embodiments have been described, it will be understood by those skilled in the art that various changes may be made and equivalents may be substituted for elements thereof without departing from the scope of the invention. In addition, many modifications may be made to adapt a particular situation or material to the various embodiments or inventive teachings without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. An enhanced linear shaped explosive device (X-Jet), comprising:

a sheath extending along an axis between a first end and a second end to define a sheath length, the sheath having a first hollowed chevron-shaped cross-section that defines a main charge cavity, an upper apex, and a lower apex, the main charge cavity loaded with a main explosive charge material; and a spinal charge element located within the main charge cavity and abutting the upper apex, the spinal charge element having a spinal casing that is formed integrally with the upper apex and that extends along the sheath length to define a spinal length and having a second hollowed cross-section defining a spinal charge cavity, the spinal charge cavity loaded with a spinal explosive charge material.

2. The X-Jet of claim 1, wherein the sheath and the spinal charge element are formed from the same material such that the spinal casing is formed integrally with the upper apex.

3. The X-Jet of claim 1, wherein the spinal casing is aligned with the upper apex and lower apex.

4. The X-Jet of claim 3, wherein the spinal charge element has one of a circular-shaped cross-section, a square-shaped cross-section, a diamond-shaped cross-section, or polygonal-shape cross-section.

5. The X-Jet of claim 4, wherein the upper apex has a hollow void extending therethrough, the void surrounded by the upper apex and the integrally formed spinal casing defining the spinal charge cavity.

6. The X-Jet of claim 5, wherein the main charge cavity contains the main charge material configured to generate a main detonation wave having a main detonation velocity, and the spinal charge cavity contains the spinal charge material configured to generate a spinal detonation wave having a spinal detonation velocity that is greater than the main detonation velocity.

7. The X-Jet of claim 6, wherein the spinal detonation wave travels in a spinal direction parallel to the sheath length, and the main detonation wave travels in a direction perpendicular to the spinal detonation wave.

8. The X-Jet of claim 7, wherein the main detonation wave generates a molten jet that is projected from the sheath and that travels in a direction parallel to the main detonation wave.

9. The X-Jet of claim 8, wherein a packing density of the spinal charge material contained in the spinal charge cavity is greater than a packing density of the main charge material contained in the main charge cavity.

10. The X-Jet of claim 5, wherein a first size of the spinal charge element is less than a second size of the upper apex such that no air gap exists between the sheath and the spinal casing.

11. The X-Jet of claim 10, wherein no air gap exists between the spinal charge element and the explosive charge material within the main charge cavity.

12. The X-Jet of claim 10, wherein the explosive charge material within the main charge cavity directly contacts an entire outer surface of the spinal charge element and directly contact an inner surface of the main charge cavity.

* * * * *